US009109817B2

(12) United States Patent
Cho et al.

(10) Patent No.: US 9,109,817 B2
(45) Date of Patent: Aug. 18, 2015

(54) AIR CONDITIONER AND METHOD OF OPERATING AN AIR CONDITIONER

(75) Inventors: Changhwan Cho, Changwon-si (KR); Hongseok Choi, Changwon-si (KR); Sunyoung Kang, Changwon-si (KR); Junhyeon Hwang, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 407 days.

(21) Appl. No.: 13/616,975

(22) Filed: Sep. 14, 2012

(65) Prior Publication Data

US 2013/0098073 A1 Apr. 25, 2013

(30) Foreign Application Priority Data

Oct. 25, 2011 (KR) ..... 10-2011-0109424
Oct. 25, 2011 (KR) ..... 10-2011-0109425

(51) Int. Cl.
*F25B 7/00* (2006.01)
*F25B 13/00* (2006.01)

(52) U.S. Cl.
CPC ..... *F25B 13/00* (2013.01); *F25B 2313/001* (2013.01); *F25B 2313/004* (2013.01); *F25B 2313/006* (2013.01); *F25B 2313/023* (2013.01); *F25B 2313/029* (2013.01); *F25B 2313/02741* (2013.01)

(58) Field of Classification Search
CPC ..... F25B 7/00; F25B 13/00; F25B 41/062; Y02B 30/123
USPC ..... 62/79, 159, 238.1, 238.7
See application file for complete search history.

(56) References Cited

U.S. PATENT DOCUMENTS 4,019,679 A 4/1977 Vogt et al.
4,238,933 A 12/1980 Coombs
5,575,159 A 11/1996 Dittell
6,035,653 A * 3/2000 Itoh et al. ..... 62/228.4

(Continued)

FOREIGN PATENT DOCUMENTS

GB 2 253 037 A 8/1992
JP 05-118670 5/1993

(Continued)

OTHER PUBLICATIONS

Korean Notice of Allowance dated Feb. 13, 2013.

(Continued)

*Primary Examiner* — Melvin Jones
(74) *Attorney, Agent, or Firm* — KED & Associates, LLP

(57) ABSTRACT

An air conditioner and a method of operating an air conditioner are provided. The air conditioner may include a heat pump having a water-refrigerant heat exchanger that condenses or evaporates a refrigerant by heat exchange with heat source water; a heat source water flow path connected to the water-refrigerant heat exchanger; a pump installed on the heat source water flow path; a variable flow valve installed on the heat source water flow path; and a variable flow valve controller that controls an opening degree of the variable flow valve. The variable flow valve controller may include a heat source water minimum flow manipulator that manipulates a minimum flow rate of the heat source water and regulates the opening degree of the variable flow valve according to the manipulation of the heat source water minimum flow manipulator. Accordingly, a user or installation personnel may selectively regulate power consumption and efficiency as desired.

24 Claims, 8 Drawing Sheets

(56) References Cited

U.S. PATENT DOCUMENTS

| | | | | |
|---|---|---|---|---|
| 2004/0134206 | A1 | 7/2004 | Lee et al. | |
| 2011/0167843 | A1 * | 7/2011 | Ueda et al. | 62/79 |

FOREIGN PATENT DOCUMENTS

| | | | |
|---|---|---|---|
| JP | 2691009 | B2 | 12/1997 |
| JP | 10-106831 | | 4/1998 |
| JP | 2006-078015 | | 3/2006 |
| JP | 2007-298235 | | 11/2007 |
| JP | 2009-031866 | | 2/2009 |
| JP | 2011-094937 | | 5/2011 |
| KR | 10-1999-0048126 | | 7/1999 |
| KR | 10-0721109 | | 5/2007 |
| KR | 10-0830663 | | 5/2008 |
| KR | 10-2010-0058030 | | 6/2010 |
| KR | 10-2010-0064835 | | 6/2010 |

OTHER PUBLICATIONS

International Search Report dated Feb. 19, 2013. (PCT/KR2012/007775).

European Third Party Observation dated Sep. 24, 2014, issued in Application No. 20120183014.

Korean Notice of Allowance dated Apr. 18, 2013.

European Search Report dated Jan. 20, 2015 issued in Application No. 12183014.5.

* cited by examiner

AIR CONDITIONER AND METHOD OF OPERATING AN AIR CONDITIONER

CROSS-REFERENCE TO RELATED APPLICATION(S)

This application claims priority under 35 U.S.C. §119 to Korean Application Nos. 10-2011-0109424 and 10-2011-0109425 filed in Korea on Oct. 25, 2011, whose entire disclosures are hereby incorporated by reference.

BACKGROUND

1. Field

An air conditioner and a method of operating an air conditioner are disclosed herein.

2. Background

Air conditioners are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
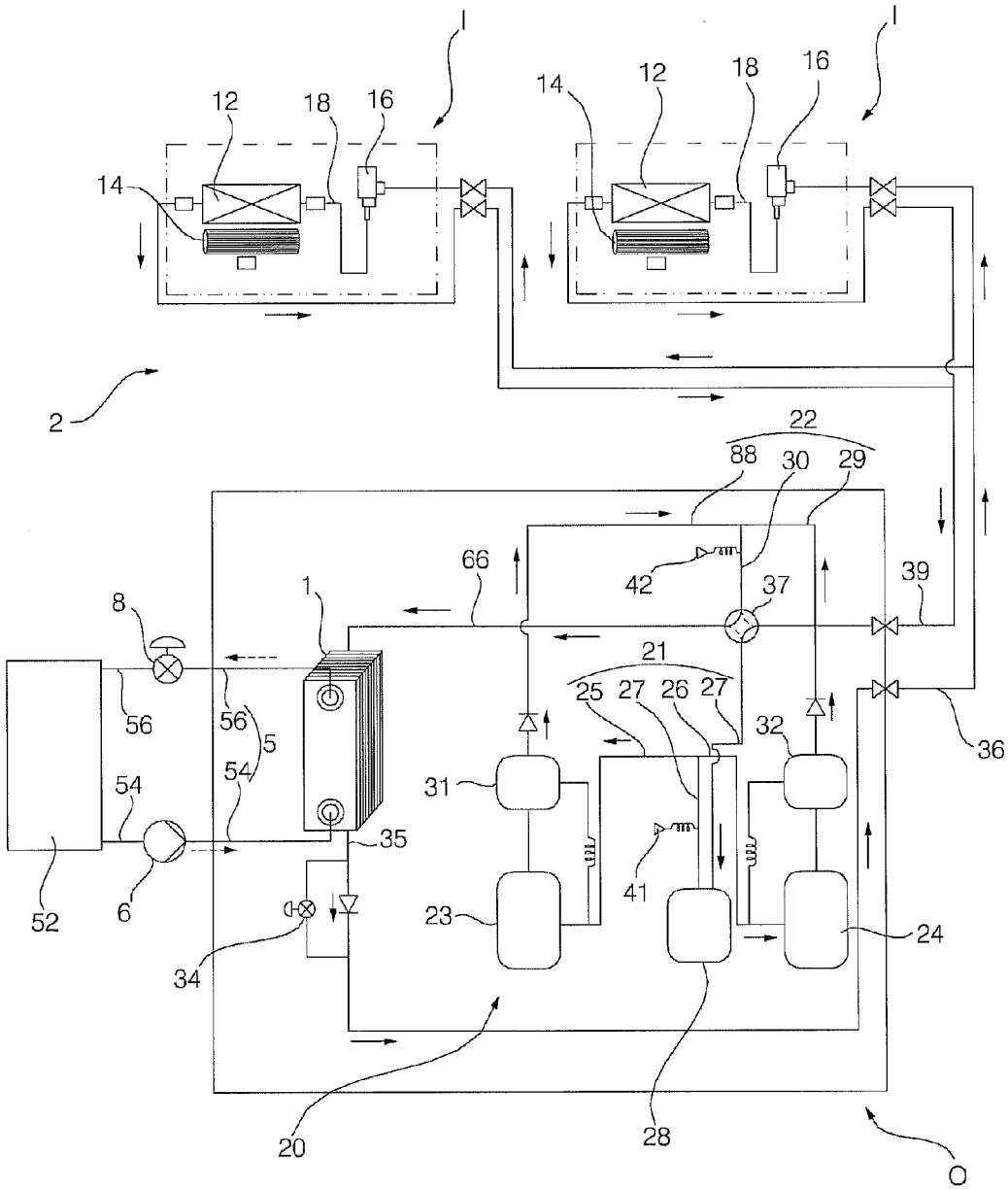
FIG. 1 is a schematic diagram showing refrigerant flow and a heat source water flow during a cooling operation of an air conditioner according to an embodiment.

Hereinafter, an air conditioner and a method of operating an air conditioner according to embodiments will be described below with reference to the accompanying drawings. Where possible like reference numerals have been used to indicate like elements.

Generally, an air conditioner is an appliance that cools or heats a room using a refrigerating cycle of a refrigerant, which performs a cooling operation or a heating operation by sequentially compressing, condensing, expanding, and evaporating the refrigerant and absorbing the surrounding heat when the refrigerant is vaporized and releasing the heat when the refrigerant is liquefied. The air conditioner may condense or evaporate the refrigerant with outdoor air, and also may condense or evaporate the refrigerant with heat source water.

The air conditioner may include a water-refrigerant heat exchanger that provides heat exchange between heat source water and a refrigerant, and which is installed between a compressor and an expansion device to allow the refrigerant to be condensed or evaporated with the water. The water-refrigerant heat exchanger may be, for example, a plate-type heat exchanger, in which a refrigerant flow path, through which a refrigerant flows, and a heat source water flow path, through which heat source water flows, are separated by a heat transfer plate.

An inflow path that supplies heat source water to the water-refrigerant heat exchanger and an outflow path that allows the heat source water heat-exchanged with the refrigerant to flow out of the heat exchanger are provided. A pump that pumps the heat source water to the water-refrigerant heat exchanger and a variable flow valve that regulates a flow rate of the heat source water coming in and out of the water-refrigerant heat exchanger may be installed in the inflow path or the outflow path.

Korean Patent Application Publication No. 10-2010-0005820 discloses an air conditioner that regulates an opening degree of a variable flow valve using an operating rate of a compressor depending on an operation capacity of an indoor unit or device, or using a temperature sensed by a water recovery tube.

Figure 2:
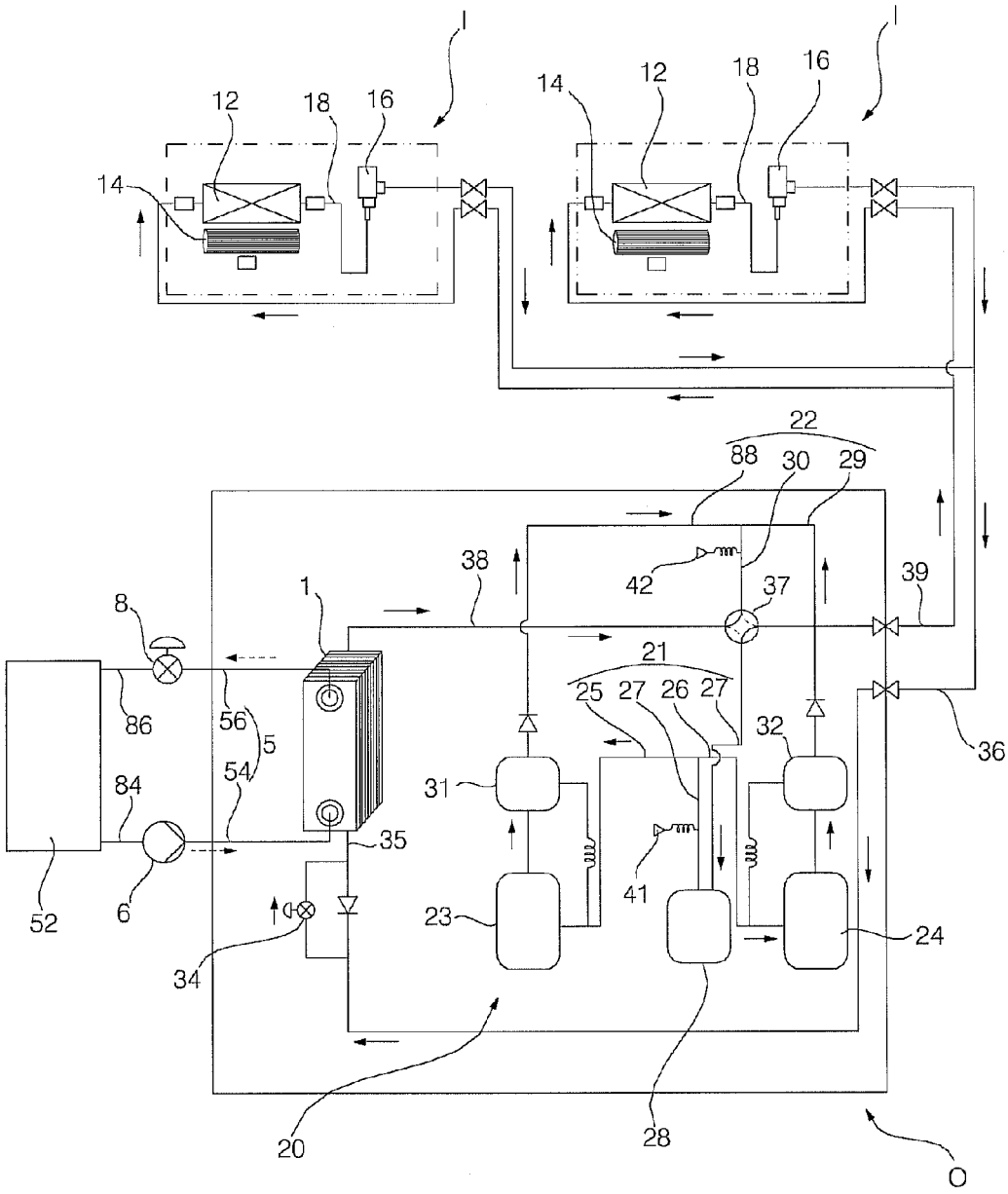
FIG. 2 is a schematic diagram showing refrigerant flow and heat source water flow during a heating operation of an air conditioner according to an embodiment.
Figure 3:
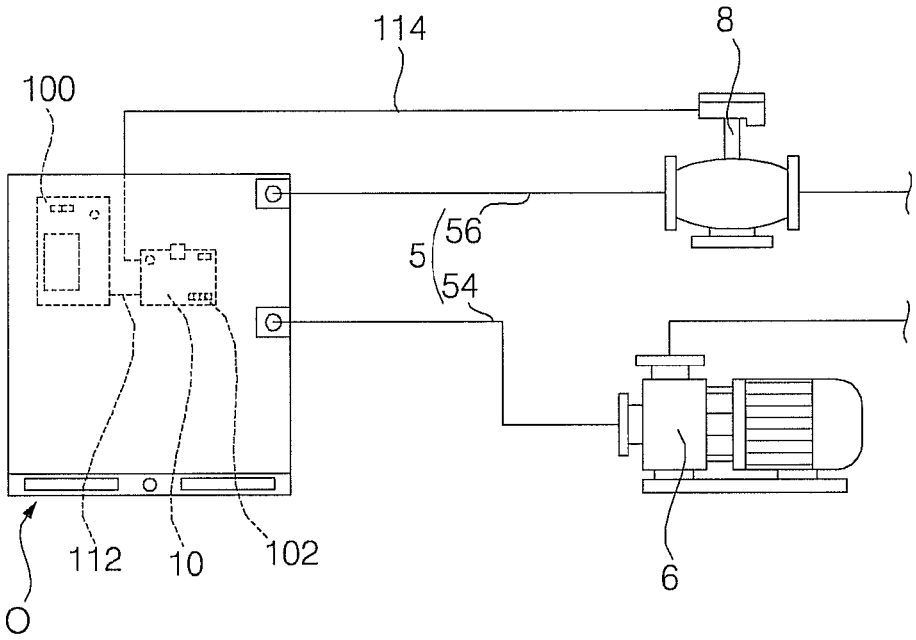
FIG. 3 is a schematic diagram of an outdoor device, a variable flow valve, and a pump in an air conditioner according to an embodiment.
Figure 4:
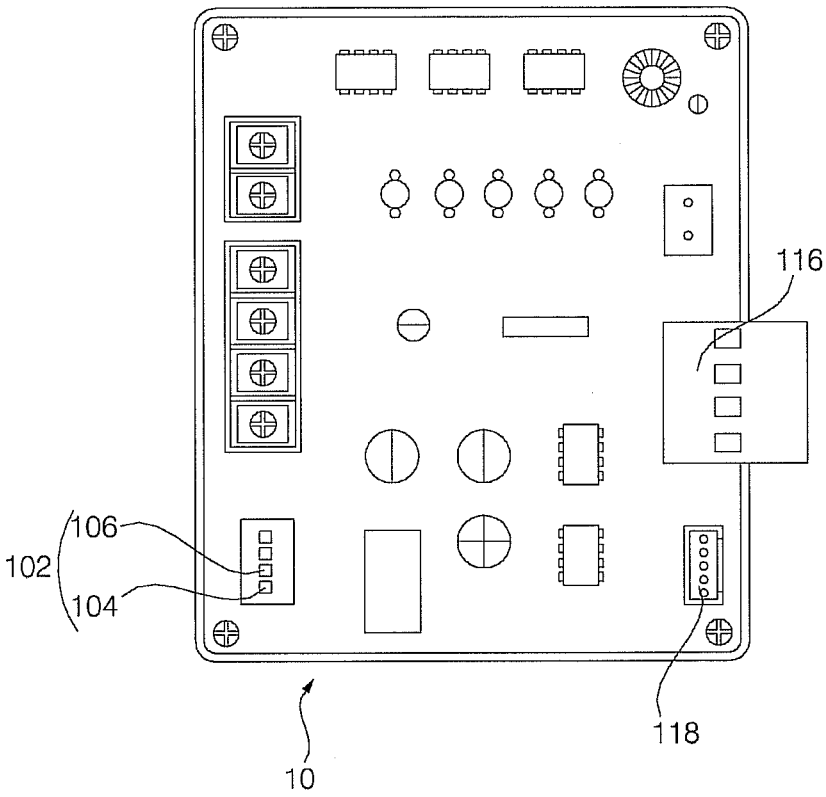
FIG. 4 is a schematic diagram of the variable flow valve controller of FIG. 3.
Figure 5:
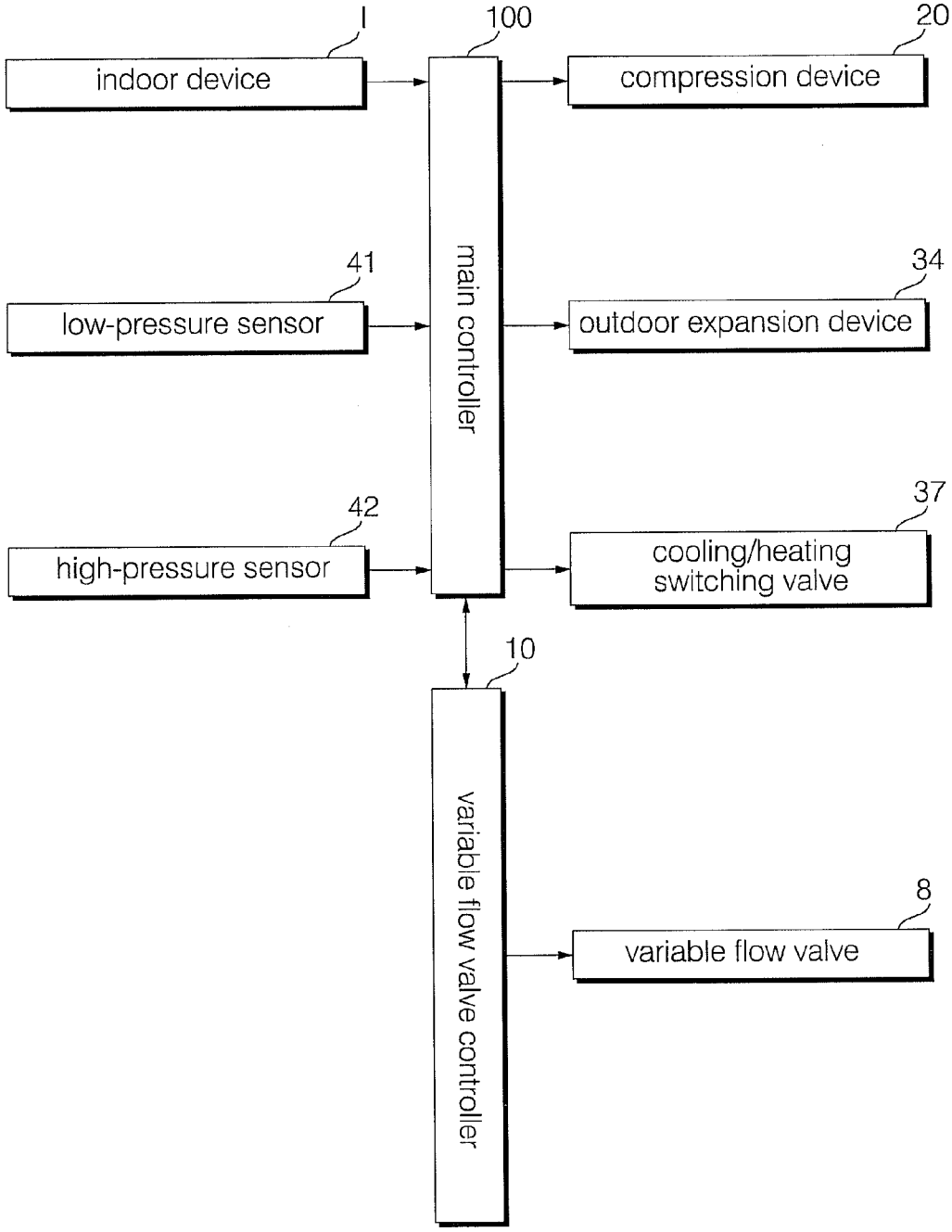
FIG. 5 is a control block diagram of an air conditioner according to an embodiment.

FIG. 1 is a schematic diagram showing refrigerant flow and heat source water flow during a cooling operation of an air conditioner according to an embodiment. FIG. 2 is a schematic diagram showing refrigerant flow and heat source water flow during a heating operation of an air conditioner according to an embodiment. FIG. 3 is a schematic diagram of an outdoor device, a variable flow valve, and a pump in the air conditioner according to an embodiment. FIG. 4 is a schematic diagram of the variable flow valve controller of FIG. 3. FIG. 5 is a control block diagram of an air conditioner according to an embodiment.

The air conditioner according to this embodiment may include a heat pump 2 having a water-refrigerant heat exchanger that condenses or evaporates a refrigerant by heat exchange with heat source water; a heat source water flow path 5 connected to the water-refrigerant heat exchanger 1; a pump 6 installed in or on the heat source water flow path 5; a variable flow valve 8 installed in or on the heat source water flow path 5; and a variable flow valve controller 10 that controls an opening degree of the variable flow valve 8. The heat pump 2 may cool or heat a room by absorbing heat from heat source water passing through the water-refrigerant heat exchanger 1 and then releasing the heat to a room, or by absorbing heat from the room and then releasing it to the heat source water passing through the water-refrigerant heat exchanger 1.

The heat pump 2 may include at least one indoor device I and at least one outdoor device O connected to the at least one indoor device I by a refrigerant flow path. A plurality of indoor devices I and/or a plurality of outdoor devices O may be provided. In such a case, refrigerant flow paths may be connected in parallel.

Each indoor device I may include an indoor heat exchanger 12 that heat-exchanges with indoor air. Further, each indoor device I may include an indoor fan 14 that blows indoor air to the indoor heat exchanger 12 and then discharges it to a room. An indoor expansion device 16 may expand the refrigerant flowing to the indoor heat exchanger 12. The indoor expansion device 16 may be installed in the indoor device I, together with the indoor heat exchanger 12 and the indoor fan 14, and may be, for example, an electronic expansion valve, such as a LEV (linear expansion valve). The indoor expansion device 16 may be connected to the indoor heat exchanger 12 by an indoor heat exchanger connecting flow path 18. The indoor heat exchanger 12 may function as an evaporator that evaporates the refrigerant by heat exchange with indoor air when a low-temperature, low-pressure refrigerant expanded by the indoor expansion device 16 passes therethrough; whereas, the indoor heat exchanger 12 may function as a condenser that condenses the refrigerant by heat-exchange with indoor air when a high-temperature, high-pressure refrigerant flowing from the outdoor device(s) O passes therethrough.

Each outdoor device O may include a compression device 20 that sucks in and compresses a refrigerant and then discharges it. The compression device 20 may suck in and compress the refrigerant from a refrigerant intake passage 21 and may then discharge it to a refrigerant discharge passage 22. The compression device 20 may be variable in capacity. The compression device 20 may include at least one compressor connected to the refrigerant intake passage 21 and the refrigerant discharge passage 22. Further, the at least one compressor may include one inverter compressor having a variable compression capacity, or may include an inverter compressor with variable compression capacity and a constant speed compressor having a constant compression capacity. The following description will be made with respect to an example including an inverter compressor 23 and a constant speed compressor 24.

The refrigerant intake passage 21 may be connected in parallel to the inverter compressor 23 and the constant speed compressor 24. The refrigerant intake passage 21 may include an inverter compressor intake passage 25 connected to the inverter compressor 23, a constant speed compressor intake passage path 26 connected to the constant speed compressor 24, and a common intake passage 27 connected to the inverter compressor intake passage 25 and the constant speed compressor intake passage 26.

An accumulator 28 that accumulates liquid refrigerant from the refrigerant may be installed on the refrigerant intake passage 21. The accumulator 28 may be installed on the common intake passage 27.

The refrigerant discharge passage 22 may be connected in parallel to the inverter compressor 23 and the constant speed compressor 24. The refrigerant discharge passage 22 may include an inverter compressor discharge passage 88 connected to the inverter compressor 23, a constant speed compressor discharge passage 29 connected to the constant speed compressor 24, and a common discharge passage 30 connected to the inverter compressor discharge passage 28 and the constant speed discharge passage 29.

An inverter compressor oil separator 31 may be installed on the refrigerant discharge passage 22 to separate oil from the refrigerant discharged from the inverter compressor 23 and return it to the refrigerant intake passage 21. A constant speed compressor oil separator 32 may be installed on the refrigerant discharge passage 22 to separate oil from the refrigerant discharged from the constant speed compressor 24 and return it to the refrigerant intake passage 21.

Each outdoor device O may include an outdoor expansion device 34 that expands the refrigerant flowing to the water-refrigerant heat exchanger 1. The outdoor expansion device 34 may be connected to the water-refrigerant heat exchanger 1 by a water-refrigerant heat exchanger connecting flow path 35. The outdoor expansion device 34 may be connected to the indoor expansion device 16 by a refrigerant flow path 36. The outdoor expansion device 34 may include an outdoor expansion valve 34A that expands the refrigerant passing therethrough during a heating operation, and may further include a bypass passage 34B that allows the refrigerant flowing from the water-refrigerant heat exchanger 1 to bypass the outdoor expansion valve 34A during a cooling operation and a check valve 34C installed on the bypass passage 34B.

Each outdoor device O may further include a low-pressure sensor 41 that senses a pressure of the refrigerant intake passage 21, and a high-pressure sensor 42 that senses a pressure of the refrigerant discharge passage 22. The low-pressure sensor 41 may be installed on the refrigerant intake passage 21, for example, on the common intake passage 27 of the refrigerant intake passage 21 to sense the pressure of the refrigerant passing through the common intake passage 27. The high-pressure sensor 42 may be installed on the refrigerant discharge passage 22, for example, on the common discharge passage 30 of the refrigerant discharge passage 22 to sense the pressure of the refrigerant passing through the common discharge passage 30.

The water-refrigerant heat exchanger 1 may function as a condenser that condenses the refrigerant by heat-exchange with heat source water when a high-temperature, high-pressure refrigerant discharged from the compression device 20 passes therethrough, or may function as an evaporator that evaporates the refrigerant by heat-exchange with heat source water when a low-temperature, low-pressure refrigerant flowing from the outdoor expansion device 34 passes therethrough. The water-refrigerant heat exchanger 1 may include with a refrigerant heat exchange passage that condenses or evaporates a refrigerant passing therethrough and a heat source water heat exchange passage that heats or cools heat source water passing therethrough.

The air conditioner may be a combined cooling/heating air conditioner having a cooling cycle and a heating cycle, and may further include a cooling/heating switching valve 37 that switches between a cooling operation and a heating operation. The cooling/heating switching valve 37 may be installed in or on the indoor device O, together with the compression device 20 and the outdoor expansion device 34. The cooling/heating switching valve 37 may be in communication with or connected to the refrigerant intake passage 21, the refrigerant discharge passage 22, the water-refrigerant heat exchanger 1, and the indoor heat exchanger(s) 12. The cooling/heating switching valve 37 may be connected to the common intake passage 27 of the refrigerant intake passage 21. The cooling/heating switching valve 37 may be connected to the common discharge passage 30 of the refrigerant discharge passage 22. The cooling/heating switching valve 37 may be connected to the water-refrigerant heat exchanger 1 by a connecting passage 38. The cooling/heating switching valve 37 may be connected to the indoor heat exchanger(s) 12 by a refrigerant flow path 39.

In a cooling operation, the cooling/heating switching valve 37 may guide the refrigerant compressed in the compression device(s) 20 and discharged to the refrigerant discharge passage 22 to flow to the water-refrigerant heat exchanger 1 and guide the refrigerant flowing from the indoor heat exchanger (s) 12 to flow to the refrigerant intake passage 21. In a heating operation, the cooling/heating switching valve 37 may guide the refrigerant compressed in the compression device(s) 20 and discharged to the refrigerant discharge passage 22 to flow to the indoor heat exchanger(s) 12 and guide the refrigerant flowing from the water-refrigerant heat exchanger 1 to flow to the refrigerant intake passage 21.

The heat source water flow path 5 may be connected to external heat exchange equipment 52 that heat-exchanges the heat source water, which may be heat-exchanged with the refrigerant in the water-refrigerant heat exchanger 1, with outdoor air or ground heat. The heat source water flow path 5 may include an inflow path 54 that allows the heat source water having passed through the external heat exchange equipment 52 to flow into the water-refrigerant heat exchanger 1, and an outflow path 56 that allows the heat source water heat-exchanged with the refrigerant in the water-refrigerant heat exchanger 1 to flow out to the external heat exchange equipment 52. The external heat exchange equipment 52 may include a cooling tower that cools the heat source water having flowed out through the outflow path 56 with outdoor air, a ground heat exchanger that provides heat exchange between the heat source water having flowed out through the outflow path 56 with ground heat, or a boiler that heats the heat source water having flowed out through the outflow path 56. Alternatively, the external heat exchange equipment 52 may be a combination of the cooling tower, the ground heat exchanger, and/or the boiler.

The pump 6 may allow heat source water to circulate through the water-refrigerant heat exchanger 1 and the external heat exchange equipment 52. The pump 6 may pump heat source water so that the heat source water circulates through the water-refrigerant heat exchanger 1, the outflow path 56, the external heat exchange equipment 52, and the inflow path 54. The pump 6 may be installed on or in at least one of the inflow path 54 or the outflow path 56. The pump 6 may be a variable capacity pump, or an inverter pump that varies in capacity depending on input frequency, or a plurality of constant speed pumps having a variable pumping capacity. The pump 6 may include a pressure sensor that senses a pressure. If a pressure drop becomes larger due to a decrease in the opening degree of the variable flow valve 8, the pressure sensor may sense this, a number of turns of the pump 6 may be decreased, and power consumption input to the pump 6 minimized. On the other hand, if a pressure drop becomes smaller due to an increase in the opening degree of the variable flow valve 8, the pressure sensor may sense this, and the number of turns of the pump 6 may be increased.

The variable flow valve 8 may regulate the heat source water flowing in and out of the water-refrigerant heat exchanger 1. The flow rate of the heat source water circulating through the heat source water flow path 5 may be varied by regulating the opening degree of the variable flow valve 8. The variable flow valve 8 may be installed on at least one of the inflow path 54 or the outflow path 56.

The flow rate of the heat source water flow path 5 may be maximized when the opening degree of the variable flow valve 8 is maximum, and the flow rate of the heat source water flow path 5 may be minimized when the opening degree of the variable flow valve 8 is minimum. The variable flow valve 8 may be fully opened at a start-up of a cooling operation or a heating operation. That is, the variable flow valve 8 may be opened to the maximum opening degree at the start-up of the cooling operation or heating operation, thereby maximizing the flow rate of the heat source water through the heat source water flow path 5. When the start-up of the cooling operation is completed, the opening degree may be varied, and the flow rate of the heat source flow path 5 may be regulated to be different from that for the start-up of the cooling operation. When the start-up of the heating operation is completed, the opening degree may be varied, and the flow rate of the heat source flow path 5 may be regulated to be different from that for the start-up of the heating operation.

When increasing the opening degree of the variable flow valve 8, the variable flow valve 8 may be regulated to an opening degree obtained by increasing the current opening degree by a predetermined opening degree. When decreasing the opening degree of the variable flow valve 8, the variable flow valve 8 may be regulated to an opening degree obtained by decreasing the current opening degree by a predetermined opening degree. When increasing or decreasing the opening degree of the variable flow valve 8 a plurality of times, the opening degree may be gradually increased or decreased in increments of a set or predetermined opening degree.

The variable flow valve controller 10 may variably control the opening degree of the variable flow valve 8. The variable flow valve controller 10 may output a control value or signal to the variable flow valve 8 to control the opening degree of the variable flow valve 8.

The variable flow valve controller 10 may control the opening degree of the variable flow valve 8 according to a load of the outdoor device(s) O. In a cooling operation, if the pressure of the refrigerant compressed in the compression device(s) 20 and then flowing to the water-refrigerant heat exchanger 1 is higher than a target condensation pressure, the variable flow valve controller 10 may increase the opening degree of the variable flow valve 8. Upon an increase in the opening degree, if the current opening degree of the variable flow valve 8 is the maximum opening degree, the current opening degree may be maintained.

In the cooling operation, if the pressure of the refrigerant compressed in the compression device(s) 20 and then flowing to the water-refrigerant heat exchanger 1 is lower than the target condensation pressure, the variable flow valve controller 10 may decrease the opening degree of the variable flow valve 8. Upon a decrease in the opening degree, if the current opening degree of the variable flow valve 8 is the minimum opening degree, the current opening degree may be maintained. The high-pressure sensor 48 may sense the pressure of the refrigerant compressed in the compression device(s) 20 and then flowing to the water-refrigerant heat exchanger 1. That is, in the cooling operation, if the pressure sensed by the high-pressure sensor 42 is lower than the target condensation pressure, the air conditioner may decrease the opening degree of the variable flow valve 8; whereas, if the pressure sensed by the high-pressure sensor 42 is higher than the target condensation pressure, the air conditioner may increase the opening degree of the variable flow valve 8.

In a heating operation, if the pressure of the refrigerant compressed in the compression device(s) 20 and then flowing to the water-refrigerant heat exchanger 1 is higher than a target condensation pressure, the variable flow valve controller 10 may decrease the opening degree of the variable flow valve 8. Upon a decrease in the opening degree, if the current opening degree of the variable flow valve 8 is the minimum opening degree, the current opening degree may be maintained.

In the heating operation, if the pressure of the refrigerant compressed in the compression device(s) 20 and then flowing to the water-refrigerant heat exchanger 1 is lower than the target condensation pressure, the variable flow valve controller 10 may increase the opening degree of the variable flow valve 8. Upon an increase in the opening degree, if the current opening degree of the variable flow valve 8 is the maximum opening degree, the current opening degree may be maintained.

The low-pressure sensor 41 may sense the pressure of the refrigerant compressed in the compression device(s) 20 and then flowing to the water-refrigerant heat exchanger 1. That is, in the heating operation, if the pressure sensed by the low-pressure sensor 41 is higher than the target condensation pressure, the air conditioner may decrease the opening degree of the variable flow valve 8; whereas, if the pressure sensed by the low-pressure sensor 41 is lower than the target condensation pressure, the air conditioner may increase the opening degree of the variable flow valve 8.

The variable flow valve controller 10 may include a heat source water minimum flow manipulation device 102 that manipulates a minimum flow of heat source water, and the variable flow valve controller 10 may regulate the opening degree of the variable flow valve 8 according to the manipulation of the heat source water minimum flow manipulation device 102. The variable flow valve controller 10 may set one of a plurality of control lower limits upon manipulation of the heat source water minimum flow manipulation device 102. The plurality of control lower limits may be control values between a minimum opening degree control value corresponding to the minimum opening degree of the variable flow valve 8 and a maximum opening degree control value corresponding to the maximum opening degree of the variable flow valve 8. The plurality of control lower limits may be gradually increased in increments of a set or predetermined value. One may be set by the variable flow valve controller 10.

For example, if the control lower limit of the variable flow valve 8 ranges from approximately 0V to approximately 10V, the minimum opening degree control value corresponding to the minimum opening degree of the variable flow valve 8 may be approximately 0 V, the maximum opening degree control value corresponding to the maximum opening degree of the variable flow valve 8 may be approximately 10 V, and a plurality of control lower limits may be set in the range between approximately 0 V and approximately 10 V. The control lower limit may be set to approximately 2 V, approximately 4 V, approximately 6 V, and approximately 8 V, for example. In this case, the minimum flow rate of heat source water may be set to approximately 20%, approximately 40%, approximately 60%, and approximately 80% of the maximum flow rate of heat source water, for example. Alternatively, the control lower limit may be set to approximately 3 V, approximately 5 V, approximately 7 V, and approximately 9 V, for example. In this case, the minimum flow rate of heat source water may be set to approximately 30%, approximately 50%, approximately 70%, and approximately 90% of the maximum flow rate of heat source water, for example.

The heat source water minimum flow rate manipulation device 102 may include a plurality of dip switches 104 and 106, as shown in FIG. 4, and may set a control lower limit of the variable flow valve 8 by a switching combination of the plurality of dip switches 104 and 106. The heat source water minimum flow manipulation device 102 may set the control lower limit set by the switching combination of the plurality of dip switches 104 and 106 to be different between the cooling operation and the heating operation. If the switching combination of the plurality of dip switches 104 and 106 is the same for both the cooling operation and the heating operation, the control lower limit for the heating operation may be set higher than the control lower limit for the cooling operation.

Table 1 is a table illustrating an example of the control lower limits set in the range of approximately 0 V to approximately 10 V by switching combinations of the heat source water flow manipulation device during the cooling operation and during the heating operation.

TABLE 1

| Dip switch 1 | Dip switch 2 | Control lower limit for cooling operation | Control lower limit for heating operation |
|---|---|---|---|
| OFF | OFF | 8 V | 9 V |
| OFF | ON | 6 V | 7 V |
| ON | OFF | 4 V | 5 V |
| ON | ON | 2 V | 3 V |

For example, assuming that the control value of the variable flow valve 8 ranges from approximately 0 V to approximately 10 V, if both dip switch 1 and dip switch 2 are OFF and a cooling operation is performed, the control lower limit set by the heat source water minimum flow manipulation device 102 may be approximately 8 V, and the variable flow valve controller 10 may output a control value in the range of approximately 8 V to approximately 10 V to the variable flow valve 8. Assuming that the control value of the variable flow vale 8 ranges from approximately 0 V to approximately 10 V, if both dip switch 1 and dip switch 2 are OFF and a heating operation is performed, the control lower limit set by the heat source water minimum flow manipulation device 102 may be approximately 9 V, and the variable flow valve controller 10 may output a control value in the range of approximately 9 V and approximately 10 V, which may be higher than the control value range for the cooling operation, to the variable flow valve 8.

Assuming that the control value of the variable flow valve 8 ranges from approximately 0 V to approximately 10 V, if both dip switch 1 and dip switch 2 are ON and a cooling operation is performed, the control lower limit set by the heat source water minimum flow manipulation device 102 may be approximately 2 V, and the variable flow valve controller 10 may output a control value in the range of approximately 2 V to approximately 10 V to the variable flow valve 8. Assuming that the control value of the variable flow vale 8 ranges from approximately 0 V to approximately 10 V, if both dip switch 1 and dip switch 2 are ON and the heating operation is performed, the control lower limit set by the heat source water minimum flow manipulation device 102 may be approximately 3 V, and the variable flow valve controller 10 may output a control value in the range of approximately 3 V and approximately 10 V, which may be higher than the control value range for the cooling operation, to the variable flow valve 8. The variable flow valve 8 may set various control lower limits depending on the manipulation of the heat source water minimum flow manipulation device 102 and whether the cooling operation or heating operation is performed, and a detailed description of each case has been omitted.

As shown in FIG. 3, the variable flow valve controller 10 may be installed in the outdoor device O, together with a main controller 100 that controls the outdoor device O. The main controller 100 may control the compression device 20, the outdoor expansion device 34, and the cooling/heating switching valve 37 depending on an operation of the indoor device (s) I and depending on the sensing of the low-pressure sensor 41 and high-pressure sensor 42. The variable flow valve controller 10 may be connected to the main controller 100 by a main controller communication line 112. As shown in FIG. 3, the variable flow valve controller 10 may be connected to the variable flow valve 8 by a variable flow valve control line 114, and output a control value that regulates the opening degree of the variable flow valve 8 through the variable flow valve control line 144. As shown in FIG. 4, the plurality of dip switches 104 and 106 may be installed in or on the variable flow valve controller 10, and the plurality of dip switches 104 and 106 may constitute the heat source water minimum flow manipulation device 102. As shown in FIG. 4, a valve control line connector 116, to which the variable flow valve control line 114 may be connected, may be installed in or on the variable flow valve controller 10. As shown in FIG. 4, a controller communication line connector 118, to which the main controller communication line 112 may be connected, may be installed in or on the variable flow valve 10.

The variable flow valve 8 may be a valve whose control value may be increased to increase the opening degree or a valve whose control value may be decreased to increase the opening degree according to type. The variable flow valve 8 may be a valve of the type which is opened to the minimum opening degree or closed as the variable flow valve 8 is fully closed upon an input of the minimum control value, and which is opened to the maximum opening degree as the variable flow valve 8 is fully opened upon an input of the maximum control value. On the other hand, the variable flow valve 8 may be a valve of the type which is opened to the maximum opening degree as the variable flow valve 8 is fully opened upon an input of the minimum control value, and which is opened to the minimum opening degree or closed as the variable flow valve 8 is fully closed upon an input of the maximum control value.

The variable flow valve controller 10 may sense the type of the variable flow valve 8 by a pressure change in the heat pump 2 depending on a change in the control value during an operation of the air conditioner, and may control the variable flow valve 8 in a control mode corresponding to the sensed type. The control mode may include a first mode for increasing the control value to increase the opening degree of the variable flow valve 8 and a second mode for decreasing the control value to increase the opening degree of the variable flow valve 8. The variable flow valve controller 10 may control the variable flow valve 8 in any one of the first and second modes.

In a cooling operation, if the condensation pressure rises upon a decrease in the control value, the variable flow valve controller 10 may control the variable flow valve 8 in the first mode. In a cooling operation, if the condensation pressure drops upon a decrease in the control value, the variable flow valve controller 10 may control the variable flow valve 8 in the second mode. In a heating operation, if the evaporation pressure rises upon a decrease in the control value, the variable flow valve controller 10 may control the variable flow valve 8 in the first mode. In a heating operation, if the evaporation pressure drops upon a decrease of the control value, the variable flow valve controller 10 may control the variable flow valve 8 in the second mode.

The variable flow valve controller 10 may receive sensing results of the low-pressure sensor 41 and the high-pressure sensor 42 from the main controller 100 while communicating with the main controller 100. In the cooling operation, the variable flow valve controller 10 may sense a change in the condensation pressure upon receipt of the sensing result of the high-pressure sensor 42 from the main controller 100, and, in the heating operation, the variable flow valve controller 10 may sense a change in the evaporation pressure upon receipt of the sensing result of the low-pressure sensor 41 from the main controller 100.

Figure 6:
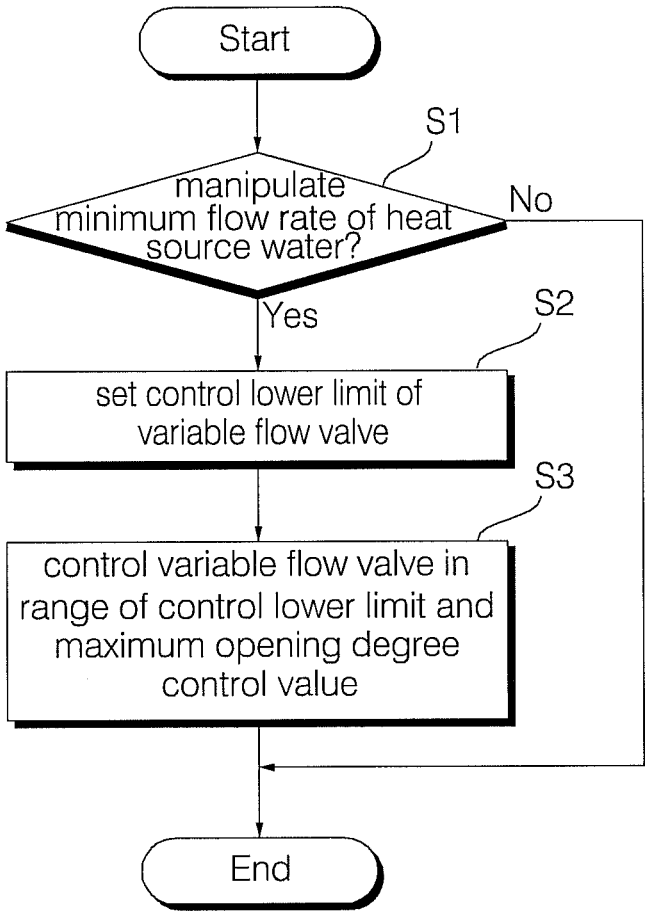
FIG. 6 is a flow chart of a method of operating an air conditioner according to an embodiment.

FIG. 6 is a flow chart of a method of operating an air conditioner according to an embodiment. The method for operating an air conditioner according to this embodiment may include manipulating a minimum flow rate of heat source water by means of a heat source water flow manipulation device, such as heat source water flow manipulation device 102 of FIG. 3, installed in a variable flow valve controller, such as variable flow valve controller 10 of FIG. 3, that regulates an opening degree of a variable flow valve, such as variable flow valve 8 of FIG. 3.

Installation personnel or a user who installs the air conditioner may manipulate on/off a plurality of dip switches, such as dip switches 104 and 106 of FIG. 4, installed in the variable flow valve controller, and may input a desired minimum flow rate of heat source water by the on/off manipulation of the plurality of dip switches.

Once the minimum flow rate of heat source water is manipulated, in step S1, a control lower limit depending on the manipulated minimum flow rate of heat source water may be set by means of the variable flow valve controller, in step S2. The variable flow valve controller may perceive a desired minimum flow rate of heat source water depending on the on/off state of the plurality of dip switches, and may set a control lower limit.

The variable flow valve controller may set one of a plurality of control lower limits. The plurality of control lower limits may be set between a minimum opening degree control value corresponding to the minimum opening degree of the variable flow valve and a maximum opening degree control value corresponding to the maximum opening degree of the variable flow valve, and the plurality of control lower limits may be gradually increased in increments of a set value (for example, 2 V). The variable flow valve controller may select any one of the plurality of control lower limits according to the on/off state of the plurality of dip switches as the control lower limit of the variable flow valve. The control lower limit may be set to be different between the cooling operation and the heating operation. If the same manipulation is input to the heat source water minimum flow manipulation device, the control lower limit for the heating operation may be set higher than the control lower limit for the cooling operation.

The air conditioner may carry out control of the variable flow valve to have a control value higher than a set control lower limit, in step S3. The variable flow valve controller may control the variable flow valve in the range of the set control lower limit and the maximum opening degree control value. The variable flow valve controller may control the variable flow valve according to a load of the outdoor device in the range of the control lower limit and the maximum opening degree control value.

Figure 7:
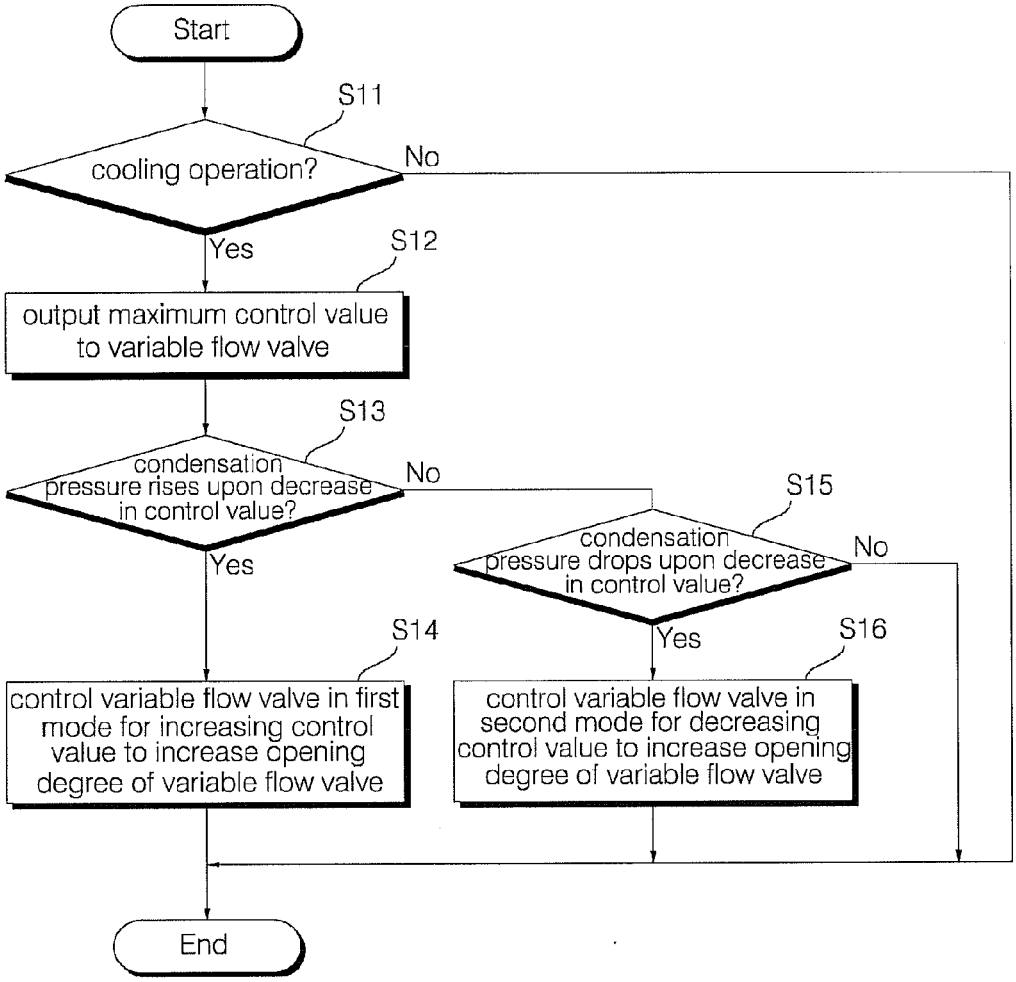
FIG. 7 is flow chart of a cooling operation in a method of operating an air conditioner according to an embodiment.

FIG. 7 is a flow chart of a cooling operation in a method of operating an air conditioner according to an embodiment. The method of this embodiment includes steps S11 and S12 of outputting a maximum control value to a variable flow valve, such as variable flow value 8 of FIGS. 1-5, in a cooling operation.

In the cooling operation, a main controller, such as main controller 100 of FIGS. 1-5, may start a compression device, such as compression device 20 of FIGS. 1-5, a pump, such as pump 6 of FIGS. 1-5, may be started, and a variable flow valve controller, such as variable flow valve controller 10 of FIGS. 1-5, may output a maximum control value to a variable flow valve, such as variable flow valve 8 of FIGS. 1-5. For example, when the variable flow valve controller outputs a control value ranging from approximately 0 V to approximately 10 V to the variable flow valve installed on a heat source water flow path, such as heat source water flow path 5 of FIGS. 1-5, the variable flow valve controller may output the maximum control value of approximately 10 V to the variable flow valve.

A refrigerant may be compressed in the compression device, condensed by heat exchange with heat source water in a water-refrigerant heat exchanger, such as water-refrigerant heat exchanger 1 of FIGS. 1-5, expanded in an indoor expansion device, such as indoor expansion device 16 of FIGS. 1-5, and evaporated by heat exchange with indoor air in an indoor heat exchanger, such as indoor exchanger 12 of FIGS. 1-5. As time gradually passes, a high pressure sensed by a high-pressure sensor, such as high pressure sensor 42 of FIGS. 1-5, may rise, and a low pressure sensed by a low-pressure sensor, such as low-pressure sensor 41 of FIGS. 1-5, may drop. After outputting the maximum control value to the variable flow valve as described above, the air conditioner may output a control value less than the maximum control value to the variable flow valve in order to decrease the opening degree of the variable flow valve.

The method of operating an air conditioner according to this embodiment may include steps S13, S14, S15, and S16 of decreasing the control value output to the variable flow valve, and controlling the variable flow valve in a first control mode for increasing the control value to increase the opening degree of the variable flow valve when the condensation pressure rises upon a decrease in the control value, and controlling the variable flow valve in a second control mode for decreasing the control value to increase the opening degree of the variable flow valve when the condensation pressure drops upon a decrease in the control value. For example, the variable flow valve controller may output approximately 8V, which is lower than the maximum control value of approximately 10V, to the variable flow valve according to the load of an outdoor device, such as outdoor device O of FIGS. 1-5. Upon a change (from approximately 10 V to approximately 8 V) in the control value of the variable flow valve, the variable flow valve controller may select one of the first control mode or the second control mode depending on whether the condensation pressure sensed by the high-pressure sensor rises or drops.

If the condensation pressure rises when the control value output to the variable flow valve is decreased from approximately 10 V to approximately 8 V, the variable flow valve controller may determine that the variable flow valve is a variable flow valve whose opening degree is increased upon an increase in the control value, and the variable flow valve controller may control the variable flow valve in the first control mode for increasing the control value to increase the opening degree of the variable flow valve, in step S13-S14. On the other hand, if the condensation pressure drops when the control value output to the variable flow valve is decreased from approximately 10 V to approximately 8 V, the variable flow valve controller 10 may determine that the variable flow valve is a variable flow valve whose opening degree is decreased upon an increase in the control value, and the variable flow valve controller may control the variable flow valve in the second control mode for decreasing the control value to increase the opening degree of the variable flow valve 8, in step S15-S16.

In the case that the variable flow valve controller controls the variable flow valve in the first control mode, when the operation of the air conditioner, in particular, the load of the outdoor unit O, is under a condition that the opening degree increases, the variable flow valve controller may output a control value higher than the previous output control value to the variable flow valve, and the opening degree of the variable flow valve may be increased. Otherwise, when the operation of the air conditioner, in particular, the load of the outdoor device, is under the condition that decreases the opening degree, the variable flow valve control controller may output a control value lower than the previous output control value to the variable flow valve, and the opening degree of the variable flow valve may be decreased, in step S14.

If a cooling operation is performed in the first control mode when the variable flow valve controller outputs a control value ranging from approximately 0 V to approximately 10 V to the variable flow valve, it may output approximately 0 V to the variable flow valve at the minimum opening degree, and may output approximately 10 V to the variable flow valve at the maximum opening degree. In the case that the variable flow valve controls the variable flow valve in the second control mode, when the operation of the air conditioner, in particular, the load of the outdoor device, is under the condition that the opening degree increases, the variable flow valve controller may output a control value lower than the previous output control value to the variable flow valve, and the opening degree of the variable flow valve may be increased. Otherwise, when the operation of the air conditioner, in particular, the load of the outdoor device, is under the condition that the opening degree decreases, the variable flow valve control controller may output a control value higher than the previous output control value to the variable flow valve, and the opening degree of the variable flow valve may be decreased, in step S16.

If a cooling operation is performed in the second control mode when the variable flow valve controller outputs a control value ranging from approximately 0 V to approximately 10 V to the variable flow valve, it may output approximately 10 V to the variable flow valve at the minimum opening degree, and may output approximately 0 V to the variable flow valve at the maximum opening degree.

Figure 8:
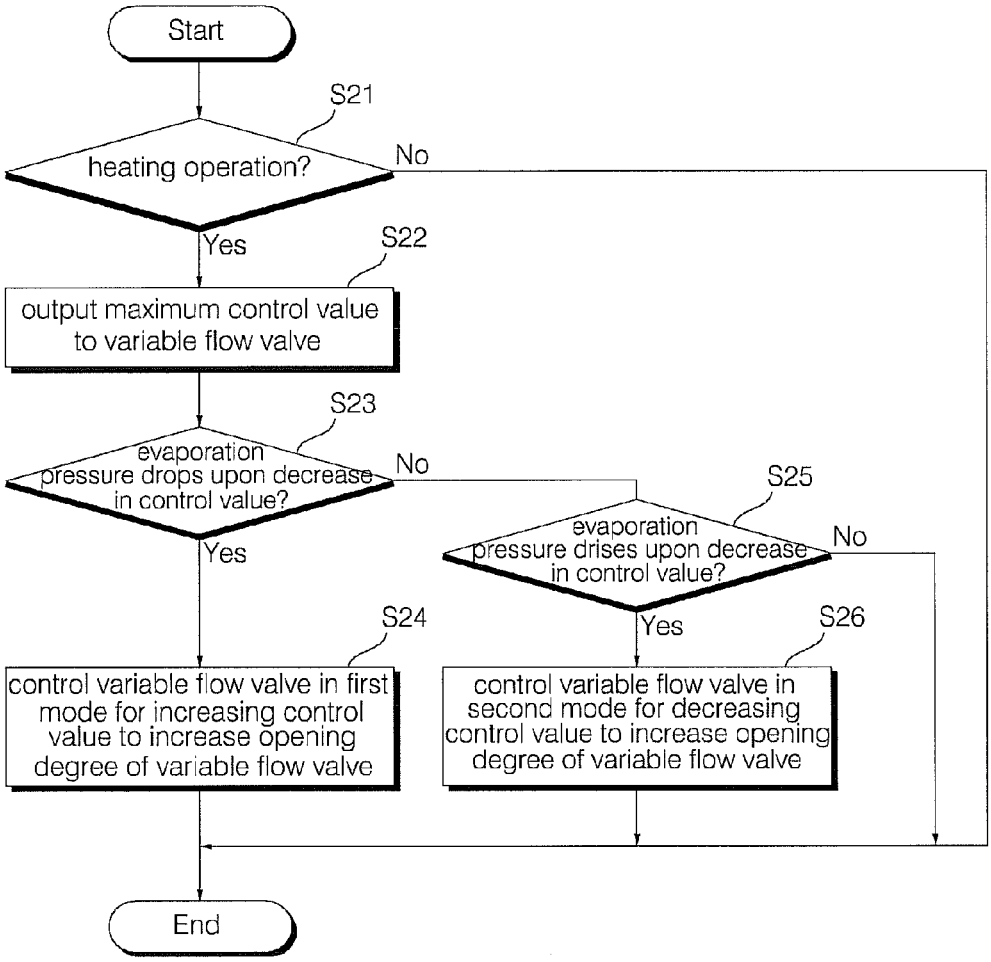
FIG. 8 is a flow chart of a heating operation in a method of operating an air conditioner according to an embodiment.

FIG. 8 is a flow chart of a heating operation in a method of operating an air conditioner according to an embodiment. The method of this embodiment may include the steps S21 and S22 of outputting the maximum control value to the variable flow valve in a heating operation.

In the heating operation, the main controller may start up the compression device, the pump may be started, and the variable flow valve controller may output a maximum control value to the variable flow valve. For example, when the variable flow valve controller outputs a control value ranging from approximately 0 V to approximately 10 V to the variable flow valve installed on the heat source water flow path, the variable flow valve controller may output the maximum control value of approximately 10 V to the variable flow valve.

A refrigerant may be compressed in the compression device, condensed by heat exchange with indoor air in the indoor heat exchanger, expanded in the outdoor expansion device, and evaporated by heat exchange with heat source water in the water-refrigerant heat exchanger. As time gradually passes, a high pressure sensed by the high-pressure sensor may rise, and a low pressure sensed by the low-pressure sensor may drop. After outputting the maximum control value to the variable flow valve as described above, the air conditioner may output a control value less than the maximum control value to the variable flow valve in order to decrease the opening degree of the variable flow valve.

The method of operating an air conditioner may include steps S23, S24, S25, and S26 of decreasing the control value output to the variable flow valve, and controlling the variable flow valve in the first control mode for increasing the control value to increase the opening degree of the variable flow valve when the evaporation pressure drops upon a decrease in the control value, and controlling the variable flow valve in the second control mode for decreasing the control value to increase the opening degree of the variable flow valve when the evaporation pressure rises upon a decrease in the control value. For example, the variable flow valve controller may output approximately 8V, which is lower than the maximum control value of approximately 10V, to the variable flow valve according to the load of the outdoor device. Upon a change (from approximately 10 V to approximately 8 V) in the control value of the variable flow valve, the variable flow valve controller may select one of the first control mode or the second control mode depending on whether the evaporation pressure sensed by the low-pressure sensor rises or drops.

If the evaporation pressure drops when the control value output to the variable flow valve is decreased from approximately 10 V to approximately 8 V, the variable flow valve controller may determine that the variable flow valve is a variable flow valve whose opening degree is increased upon an increase in the control value, and the variable flow valve controller may control the variable flow valve in the first control mode for increasing the control value to increase the opening degree of the variable flow valve, in step S23-S24. On the other hand, if the evaporation pressure rises when the control value output to the variable flow valve is decreased from approximately 10 V to approximately 8 V, the variable flow valve controller may determine that the variable flow valve is a variable flow valve whose opening degree is decreased upon an increase in the control value, and the variable flow valve controller may control the variable flow valve in the second control mode for decreasing the control value to increase the opening degree of the variable flow valve, in step S25-S26.

If a heating operation is performed in the first control mode when the variable flow valve controller outputs a control value ranging from approximately 0 V to approximately 10 V to the variable flow valve, it may output approximately 0 V to the variable flow valve at the minimum opening degree, and may output approximately 10 V to the variable flow valve at the maximum opening degree.

If a heating operation is performed in the second control mode when the variable flow valve controller outputs a control value ranging from approximately 0 V to approximately 10 V to the variable flow valve, it may output approximately 10 V to the variable flow valve at the minimum opening degree, and may output approximately 0 V to the variable flow valve at the maximum opening degree.

The first control mode of the variable flow valve controller and the corresponding increase and decrease in the opening degree of the variable flow valve during the heating operation of the air conditioner may be identical to those during the cooling operation, so a detailed description thereof has been omitted. The second control mode of the variable flow valve controller and the corresponding increase and decrease in the opening degree of the variable flow valve may be identical to those during the cooling operation, so a detailed description thereof has been omitted.

Embodiments disclosed herein provide an air conditioner, which allows a user or installation personnel to change an opening degree range of a variable flow valve by taking into account an installation environment or power consumption of the air conditioner, and a method of operating an air conditioner. Embodiments disclosed herein further provide an air conditioner, which may efficiently control a variable flow valve irrespective of a type of the variable flow valve, and a method of operating an air conditioner.

Embodiments disclosed herein provide an air conditioner that may include a heat pump having a water-refrigerant heat exchanger that condenses or evaporates a refrigerant by heat exchange with heat source water; a heat source water flow path connected to the water-refrigerant heat exchanger; a pump installed on the heat source water flow path; a variable flow valve installed on the heat source water flow path and capable of regulating an opening degree; and a variable flow valve controller that controls the opening degree of the variable flow valve. The variable flow valve controller may include a heat source water minimum flow manipulation part or device that manipulates a minimum flow rate of the heat source water and regulates the opening degree of the variable flow valve according to the manipulation of the heat source water minimum flow manipulation part.

The variable flow valve controller may set one of a plurality of control lower limits upon manipulation of the heat source water minimum flow manipulation part. The plurality of control lower limits may be control values between a minimum opening degree control value corresponding to the minimum opening degree of the variable flow valve and a maximum opening degree control value corresponding to the maximum opening degree of the variable flow valve. The plurality of control lower limits may be gradually increased in increments of a set value.

The heat source water minimum flow rate manipulation part may set a control lower limit of the variable flow valve by a switching combination of a plurality of dip switches. The heat source water minimum flow manipulation part may set the control lower limit set by the switching combination of the plurality of dip switches to be different between a cooling operation and a heating operation. If the switching combination of the plurality of dip switches is the same for both the cooling operation and the heating operation, the control lower limit for the heating operation may be set higher than the control lower limit for the cooling operation.

The variable flow valve controller may output a control value to the variable flow valve to control the opening degree of the variable flow valve, and the variable flow valve controller may sense the type of the variable flow valve by a pressure change in the heat pump depending on a change in the control value, and control the variable flow valve in the control mode corresponding to the sensed type.

The control mode may include a first mode for increasing the control value to increase the opening degree of the variable flow valve and a second mode for decreasing the control value to increase the opening degree of the variable flow valve.

In a cooling operation, if a condensation pressure rises upon a decrease in the control value, the variable flow valve controller may control the variable flow valve in the first mode. Further, in the cooling operation, if the condensation pressure drops upon a decrease in the control value, the variable flow valve controller may control the variable flow valve in the second mode.

In a heating operation, if an evaporation pressure rises upon a decrease in the control value, the variable flow valve controller may control the variable flow valve in the first mode. Further, in a heating operation, if the evaporation pressure drops upon a decrease of the control value, the variable flow valve controller may control the variable flow valve in the second mode.

Embodiments disclosed herein further provide a method of operating an air conditioner, the air conditioner including a water-refrigerant heat exchanger installed in a heat pump that condenses or evaporates a refrigerant by heat-exchange with heat source water, a heat source water flow path connected to the water-refrigerant heat exchanger, and a variable flow valve installed on the heat source water flow path and capable of regulating an opening degree. The method may include manipulating a minimum flow rate of heat source water by means of a heat source water minimum flow manipulation part or manipulator installed in a variable flow valve controller; setting a control lower limit depending on the minimum flow rate of heat source water by means of the variable flow valve controller; and controlling the variable flow valve to have a control value higher than the control lower limit. In the controlling of the variable flow valve, the variable flow valve may be controlled in a range of the set control lower limit and in the maximum opening degree control value range for controlling the variable flow valve to have the maximum opening degree.

Embodiments disclosed herein further provide a method of operating an air conditioner, the air conditioner including a water-refrigerant heat exchanger installed in a heat pump that condenses or evaporates a refrigerant by heat-exchange with heat source water, a heat source water flow path connected to the water-refrigerant heat exchanger, and a variable flow valve installed on the heat source water flow path and capable of regulating an opening degree. The method may include outputting a maximum control value from the variable flow valve controller to the variable flow valve; and after the outputting of the maximum control value, decreasing the control value output to the variable flow valve and controlling the variable flow valve. In the controlling of the variable flow valve, if a condensation pressure of a cooling operation rises or an evaporation pressure of a heating operation drops upon a decrease in the control value, the variable flow valve may be controlled in a first control mode, and, if the condensation pressure of a cooling operation drops or the evaporation pressure of a heating operation rises upon a decrease in the control value, the variable flow valve may be controlled in a second control mode, the first control mode being a control mode for increasing the control value output to the variable flow valve upon an increase in the opening degree of the variable flow valve, and the second control mode being a control mode for decreasing the control value output to the variable flow valve upon an increase in the opening degree of the variable flow valve.

If a temperature in a place in which an air conditioner is to be installed is in a good condition, it is possible for a user or installation personnel to manipulate a minimum flow rate of heat source water to a lower level, thereby minimizing power consumption of a pump. Moreover, if the temperature in a place in which an air conditioner is to be installed is in a bad condition, it is possible for a user or installation personnel to manipulate the minimum flow rate of heat source water to a higher level, thereby increasing cooling performance or heating performance.

Further, with embodiments disclosed herein, power consumption and efficiency may be selectively regulated as desired. In addition, the variable flow valve may be controlled in a control mode appropriate for a variable flow valve installed on a heat source water flow path irrespective of a type of the variable flow valve, and a variable flow valve controller may be installed for common use irrespective of the type of the variable flow valve.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a heat pump having a water-refrigerant heat exchanger that condenses or evaporates a refrigerant by heat exchange with heat source water;

a heat source water flow path connected to the water-refrigerant heat exchanger;

a variable flow valve installed on the heat source water flow path; and a variable flow valve controller that controls an opening degree of the variable flow valve, wherein the variable flow valve controller comprises a heat source water minimum flow manipulation device that manipulates a minimum flow rate of the heat source water and regulates the opening degree of the variable flow valve according to a manipulation of the heat source water minimum flow manipulation device, wherein the variable flow valve controller sets one of a plurality of control lower limits upon manipulation of the heat source water minimum flow manipulation device.

2. The air conditioner of claim 1, further comprising a pump installed on the heat source water flow path.

3. The air conditioner of claim 1, wherein the plurality of control lower limits are control values between a minimum opening degree control value corresponding to a minimum opening degree of the variable flow valve and a maximum opening degree control value corresponding to a maximum opening degree of the variable flow valve.

4. The air conditioner of claim 1, wherein the plurality of control lower limits are gradually increased in increments of a set value.

5. An air conditioner, comprising:

a heat pump having a water-refrigerant heat exchanger that condenses or evaporates a refrigerant by heat exchange with heat source water;

a heat source water flow path connected to the water-refrigerant heat exchanger;

a variable flow valve installed on the heat source water flow path; and a variable flow valve controller that controls an opening degree of the variable flow valve, wherein the variable flow valve controller comprises a heat source water minimum flow manipulation device that manipulates a minimum flow rate of the heat source water and regulates the opening degree of the variable flow valve according to a manipulation of the heat source water minimum flow manipulation device, wherein the heat source water minimum flow rate manipulation device sets a control lower limit of the variable flow valve by a switching combination of a plurality of dip switches.

6. The air conditioner of claim 5, wherein the heat source water minimum flow manipulation device sets the control lower limit set by the switching combination of the plurality of dip switches, which is different between a cooling operation and a heating operation.

7. The air conditioner of claim 6, wherein, if the switching combination of the plurality of dip switches is the same for both the cooling operation and the heating operation, the control lower limit for the heating operation is set higher than the control lower limit for the cooling operation.

8. An air conditioner, comprising:

a heat pump having a water-refrigerant heat exchanger that condenses or evaporates a refrigerant by heat exchange with heat source water;

a heat source water flow path connected to the water-refrigerant heat exchanger;

a variable flow valve installed on the heat source water flow path; and a variable flow valve controller that controls an opening degree of the variable flow valve, wherein the variable flow valve controller comprises a heat source water minimum flow manipulation device that manipulates a minimum flow rate of the heat source water and regulates the opening degree of the variable flow valve according to a manipulation of the heat source water minimum flow manipulation device, and wherein the variable flow valve controller outputs a control value to the variable flow valve to control the opening degree of the variable flow valve, and the variable flow valve controller senses a type of the variable flow valve based on a pressure change in the heat pump due to a change in the control value, and controls the variable flow valve in a control mode corresponding to a sensed type.

9. The air conditioner of claim 8, wherein the control mode comprises a first mode for increasing the control value to increase the opening degree of the variable flow valve or a second mode for decreasing the control value to increase the opening degree of the variable flow valve.

10. The air conditioner of claim 9, wherein, in a cooling operation, if a condensation pressure rises upon a decrease in the control value, the variable flow valve controller controls the variable flow valve in the first mode.

11. The air conditioner of claim 9, wherein, in a cooling operation, if a condensation pressure drops upon a decrease in the control value, the variable flow valve controller controls the variable flow valve in the second mode.

12. The air conditioner of claim 9, wherein, in a heating operation, if an evaporation pressure rises upon a decrease in the control value, the variable flow valve controller controls the variable flow valve in the first mode.

13. The air conditioner of claim 9, wherein, in a heating operation, if an evaporation pressure drops upon a decrease of the control value, the variable flow valve controller controls the variable flow valve in the second mode.

14. A method of operating an air conditioner, the air conditioner comprising a water-refrigerant heat exchanger installed in a heat pump that condenses or evaporates a refrigerant by heat-exchange with heat source water, a heat source water flow path connected to the water-refrigerant heat exchanger, and a variable flow valve installed on the heat source water flow path, the method comprising:

manipulating a minimum flow rate of heat source water via a heat source water minimum flow manipulation device installed in a variable flow valve controller;

setting a control lower limit based on the minimum flow rate of heat source water via the variable flow valve controller; and controlling the variable flow valve to have a control value higher than the control lower limit.

15. The method of claim 14, wherein, in the controlling of the variable flow valve, the variable flow valve is controlled in a range of the set control lower limit and a maximum opening degree control value corresponding to a maximum opening degree of the variable flow valve.

16. The method of claim 14, wherein, in the setting of the control lower limit, one of a plurality of control lower limits between a minimum opening degree control value corresponding to a minimum opening degree of the variable flow valve and a maximum opening degree control value corresponding to a maximum opening degree of the variable flow valve is set as the control lower limit.

17. The method of claim 16, wherein the plurality of control lower limits are gradually increased in increments of a set value.

18. The method of claim 14, wherein the control lower limit is different for a cooling operation and a heating operation.

19. The method of claim 14, wherein, if a same manipulation is input to the heat source water minimum flow manipulation device, the control lower limit for a heating operation is higher than the control lower limit for a cooling operation.

20. The method of claim 14, wherein the manipulating comprises receiving input of the minimum flow rate from a user.

21. The method of claim 20, wherein the heat source water minimum flow manipulation device includes a plurality of dip switches, and the receiving input of the minimum flow rate from a user comprises receiving input of the minimum flow rate from a user through the user's on/off manipulation of the plurality of clip switches.

22. A method of operating an air conditioner, the air conditioner comprising a water-refrigerant heat exchanger installed in a heat pump that condenses or evaporates a refrigerant by heat-exchange with heat source water, a heat source water flow path connected to the water-refrigerant heat exchanger, and a variable flow valve installed on the heat source water flow path, the method comprising:

outputting a maximum control value from a variable flow valve controller to the variable flow valve; and after the outputting of the maximum control value, decreasing the control value output to the variable flow valve and controlling the variable flow valve, wherein, in the controlling of the variable flow valve, if a condensation pressure of a cooling operation rises or an evaporation pressure of a heating operation drops upon a decrease in the control value, the variable flow valve is controlled in a first control mode, and, if the condensation pressure of the cooling operation drops or the evaporation pressure of the heating operation rises upon a decrease in the control value, the variable flow valve is controlled in a second control mode, wherein the first control mode is a control mode for increasing the control value output to the variable flow valve upon an increase in an opening degree of the variable flow valve, and the second control mode is a control mode for decreasing the control value output to the variable flow valve upon an increase in the opening degree of the variable flow valve.

23. An air conditioner, comprising:

a heat pump having a compression device that compresses a refrigerant and a water-refrigerant heat exchanger that condenses or evaporates a refrigerant by heat exchange with a heat source water;

a heat source water flow path connected to the water-refrigerant heat exchanger;

a variable flow valve installed on the heat source water flow path; and a variable flow valve controller that controls an opening degree of the variable flow valve, wherein the variable flow valve controller controls the opening degree of the variable flow valve according to at least one of a pressure of refrigerant flowing from the compression device to the water-refrigerant heat exchanger and a pressure of refrigerant flowing from the water-refrigerant heat exchanger to the compression device, and wherein the variable flow valve controller comprises a heat source water minimum flow manipulation device that manipulates a minimum flow rate of the heat source water and regulates the opening degree of the variable flow valve according to a manipulation of the heat source water minimum flow manipulation device.

24. The air conditioner of claim 23, further comprising a high-pressure sensor that sense a pressure of the refrigerant compressed in the compression device; and a low-pressure sensor that sense a pressure of the refrigerant suctioned into the compression device, wherein the variable flow valve controller controls the opening degree of the variable flow valve according to one of the pressure sensed by the high-pressure sensor and the pressure sensed by the low-pressure sensor and, wherein the variable flow valve controller controls the variable flow valve to have a control value higher than a control lower limit set according to the manipulation of the heat source water minimum flow manipulation device.

* * * * *